US007325594B2

(12) United States Patent
Wilhelm et al.

(10) Patent No.: US 7,325,594 B2
(45) Date of Patent: Feb. 5, 2008

(54) HEAT EXCHANGER

(75) Inventors: Stefan Wilhelm, Unterhaching (DE); Wolfgang Bader, Ebenhausen (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/091,350

(22) Filed: Mar. 6, 2002

(65) Prior Publication Data

US 2002/0124998 A1 Sep. 12, 2002

(30) Foreign Application Priority Data

Mar. 6, 2001 (DE) ..... 101 10 704

(51) Int. Cl.
*F28D 11/00* (2006.01)
*F28F 7/00* (2006.01)
*F28F 13/00* (2006.01)

(52) U.S. Cl. ..... 165/135; 165/76; 165/86; 165/81

(58) Field of Classification Search ..... 165/77, 165/78, 86, 81, 47, 82, 83, 135
See application file for complete search history.

(56) References Cited

U.S. PATENT DOCUMENTS

| | | | | | |
|---|---|---|---|---|---|
| 0,529,288 | A | * | 11/1894 | Morison | 165/77 |
| 1,901,014 | A | * | 3/1933 | Wallis | 165/77 |
| 2,041,483 | A | * | 5/1936 | Prestage | 165/77 |
| 2,057,298 | A | * | 10/1936 | Feldmeier | 165/77 |
| 2,200,355 | A | * | 5/1940 | Cornell, Jr. | 165/77 |
| 3,000,193 | A | * | 9/1961 | Crider | 165/77 |
| 3,204,613 | A | * | 9/1965 | David | 122/510 |
| 3,285,327 | A | * | 11/1966 | Herrick | 165/77 |
| 4,064,932 | A | * | 12/1977 | Iriarte | 165/86 |
| 4,066,119 | A | * | 1/1978 | Stedman | 165/86 |
| 4,232,455 | A | * | 11/1980 | Burton | 165/81 |
| 4,236,574 | A | * | 12/1980 | Bosne | 165/81 |
| 4,377,025 | A | | 3/1983 | Masai et al. | |
| 4,685,426 | A | * | 8/1987 | Kidaloski et al. | 122/510 |
| 4,852,640 | A | * | 8/1989 | McKenna | 165/47 |
| 5,131,459 | A | | 7/1992 | Thompson et al. | |
| 5,380,502 | A | * | 1/1995 | Murphy et al. | 165/82 |
| 5,551,381 | A | * | 9/1996 | Losel et al. | 165/81 |
| 5,916,352 | A | * | 6/1999 | Muzzarelli | 165/77 |
| 6,105,660 | A | * | 8/2000 | Knurr | 165/77 |

FOREIGN PATENT DOCUMENTS

| | | | | | |
|---|---|---|---|---|---|
| DE | 0460711 | * | 6/1928 | | 165/77 |
| DE | 3734523 | * | 4/1989 | | 165/81 |
| GB | 1085361 | | 9/1967 | | |
| JP | 0029993 | * | 2/1984 | | 165/81 |
| JP | 0074497 | * | 4/1984 | | 165/81 |
| WO | WO99/11990 | | 3/1999 | | |

* cited by examiner

*Primary Examiner*—Ljiljana Ciric
(74) *Attorney, Agent, or Firm*—Miller, White, Zelano, Branigan, P.C.

(57) ABSTRACT

A heat exchanger having at least one heat exchanger block (1) and an insulating vessel which surrounds the heat exchanger, is provided with plates and joints for securing the heat exchanger block (1) suspended in the insulation vessel. In addition, the heat exchanger block (1) is arranged movably in the insulation vessel.

29 Claims, 6 Drawing Sheets

HEAT EXCHANGER

The invention relates to a heat exchanger, having at least one heat exchanger block and an insulating vessel which surrounds the heat exchanger, in which securing means are provided for securing the heat exchanger block hanging in the insulating vessel, and to its use in a low-temperature air fractionation plant.

During the low-temperature fractionation of air, the charge air which is to be fractionated has to be cooled to the process temperature. This usually takes place through indirect heat exchange between the charge air and the product streams obtained in the air fractionation plant. In plants in which large quantities of air are processed, the principal heating exchanger is produced by a plurality of heat exchanger blocks connected in parallel The individual heat exchanger blocks are in this case generally designed as plate-type heat exchangers.

The thermal insulation of the principal heat exchanger is provided by introducing the heat exchanger into a thermally insulated insulating vessel, known as a coldbox. Various methods are known for securing the heat exchanger or the individual heat exchanger blocks in the insulating vessel.

Firstly, it is known to place the heat exchanger blocks on uprights or supports on the floor or foundation of the insulating housing. In some cases, profiled sections are also fitted to two opposite sides of the heat exchanger block, and these profiled sections are then laid on top of supports which run transversely through the insulating space and hold the heat exchanger block. It is also possible to fit tie-rods on laterally arranged profiled sections, with the aid of which rods the heat exchanger is suspended from ceiling supports of the insulating space.

Furthermore, WO 99/11990 describes holding the heat exchanger block at the warm end, i.e. in the upper region, by means of supporting brackets and clamping it at an angle in the insulating space at the cold end by means of elements in rope form.

A factor which all these securing methods have in common is that the heat exchanger block is secured rigidly in the insulating space. However, when the plant is started up or in the event of load changes, the pipelines which are connected to the heat exchanger block undergo considerable changes in length, of up to 4 mm per meter of pipe length, for temperature reasons. In order, for example, during cooling to avoid cracks or other damage to the heat exchanger block or the pipelines caused by pipe shrinkage, therefore, it has hitherto been necessary to provide line loops as shrinkage compensation or to reinforce, at high cost, the connection pieces on the heat exchanger block. As a result, the pipe length required for piping increases, the space taken up by the piping rises and the piping becomes more complicated.

Therefore, one object of the present invention to develop a heat exchanger which is secured in the insulating vessel in such a way that the piping becomes as simple as possible and the line loops for shrinkage compensation are avoided or at least minimized. Upon further study of the specification and appended claims, other objects and advantages of the invention will become apparent.

According to the present invention, there is provided a heat exchanger of the type described in the introduction in which the heat exchanger block is arranged movably in the insulating vessel.

According to the invention, the heat exchanger block is secured in such a way that thermally produced changes in the pipelines connected to the heat exchanger block are compensated for by a change in position of the block. For example, when the plant is cooling, the heat exchanger block is moved with the contracting pipelines.

It is preferable for the heat exchanger block to be secured in the insulating vessel in such a way that its lower end can move in at least two spatial directions. It is particularly preferred for the heat exchanger block to be suspended in such a manner that it can move freely above its centre of gravity.

It is usual for the warm charge air to be supplied to the upper end of the heat exchanger block and the cold product gases to be supplied to the lower end of the heat exchanger block. Accordingly, during start-up or in the event of load changes, only the pipelines which are connected to the lower, cold end of the heat exchanger block undergo significant changes in length, since the temperature changes at the warm end are only minor. The fact that the heat exchanger block is suspended above its center of gravity means that it can be moved relatively easily at its lower end. Therefore, only small forces act on the pipelines which are connected to the lower end and, through their contraction, cause the movement of the heat exchanger block. Unacceptably high stresses on the pipelines are thereby avoided.

The invention has proven particularly useful in a heat exchanger which comprises at least two, preferably at least four heat exchanger blocks. The invention is particularly suitable for heat exchangers which comprise eight or ten heat exchanger blocks in two rows of in each case four or five blocks. Relatively large heat exchangers, which comprise a plurality of heat exchanger blocks, require complex piping in order to distribute the charge air which is to be cooled and the product streams which are guided in countercurrent flow to the individual heat exchanger blocks.

The line loops which have hitherto been required as contraction lengths also make piping more difficult and, in particular, increase the space which it requires. Consequently, it is also necessary to provide larger insulating vessels, which leads to further increases in the costs of a plant of this type.

The inventive way of securing the heat exchanger blocks simplifies piping, reduces the size of the insulating vessel and therefore leads to a considerable reduction in costs. This is true in particular if the individual heat exchanger blocks have feed lines and/or discharge lines which lead into a common collection line.

It is preferable to provide securing means which have joints, so that the heat exchanger block can be moved about the joint axes. An articulated suspension of this type can be achieved with relatively little technical outlay and has proven particularly successful in practice.

BRIEF DESCRIPTION OF THE DRAWINGS

The invention and further details of the invention are explained in more detail below with reference to exemplary embodiments illustrated in the drawings, in which.

DETAILED DESCRIPTION OF THE DRAWINGS

Figure 2:
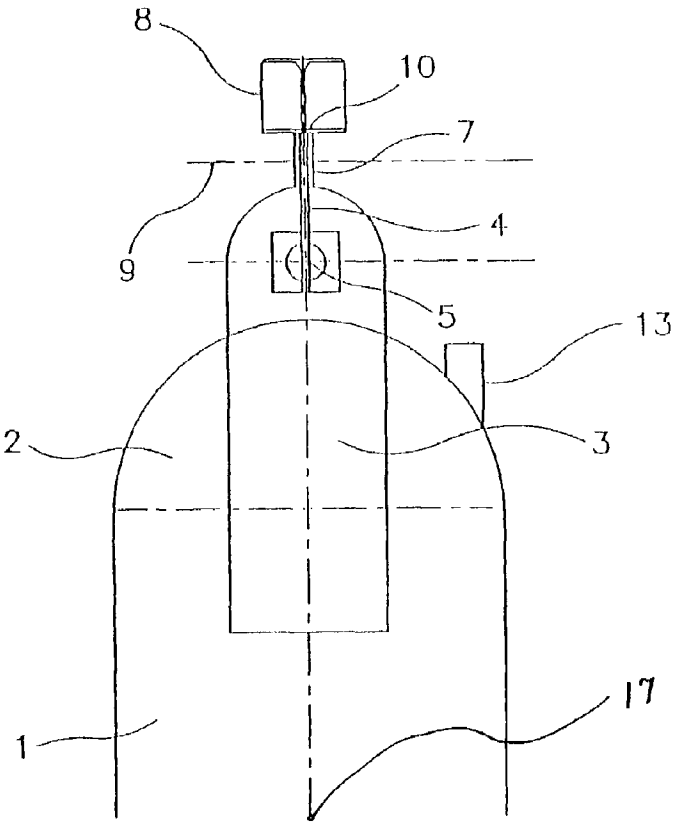
FIG. 2 shows a side view of FIG. 1.
Figure 1:
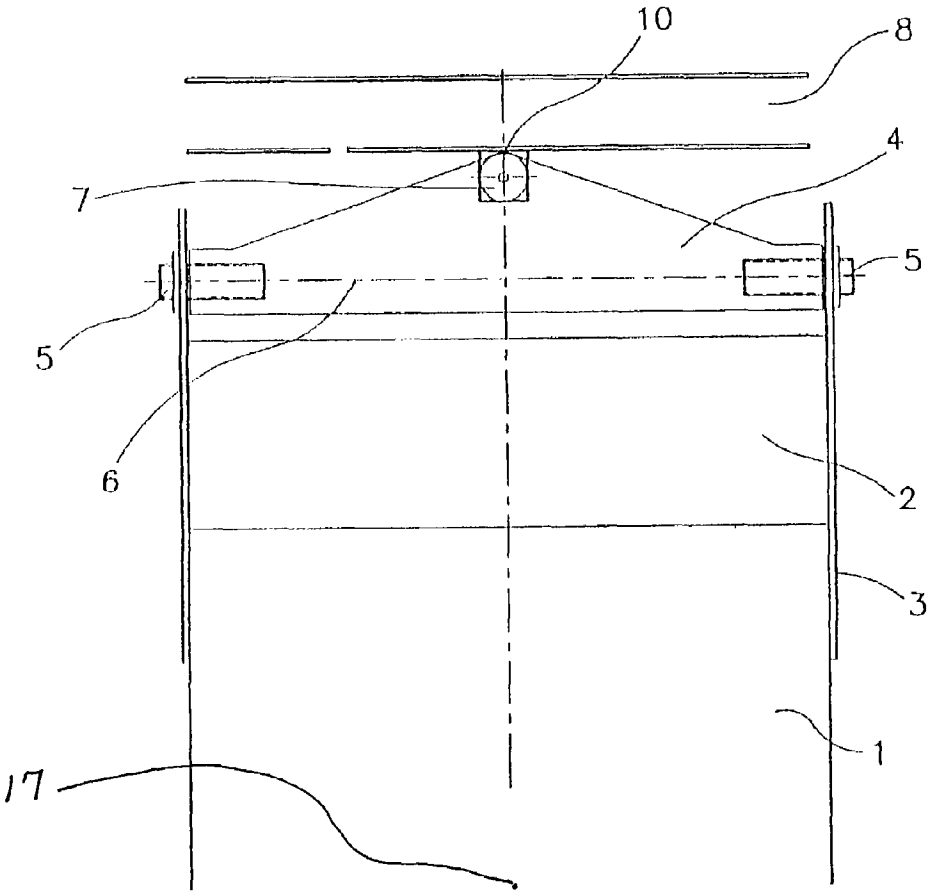
FIG. 1 diagrammatically depicts the suspension of a heat exchanger according to the invention.
Figure 3:
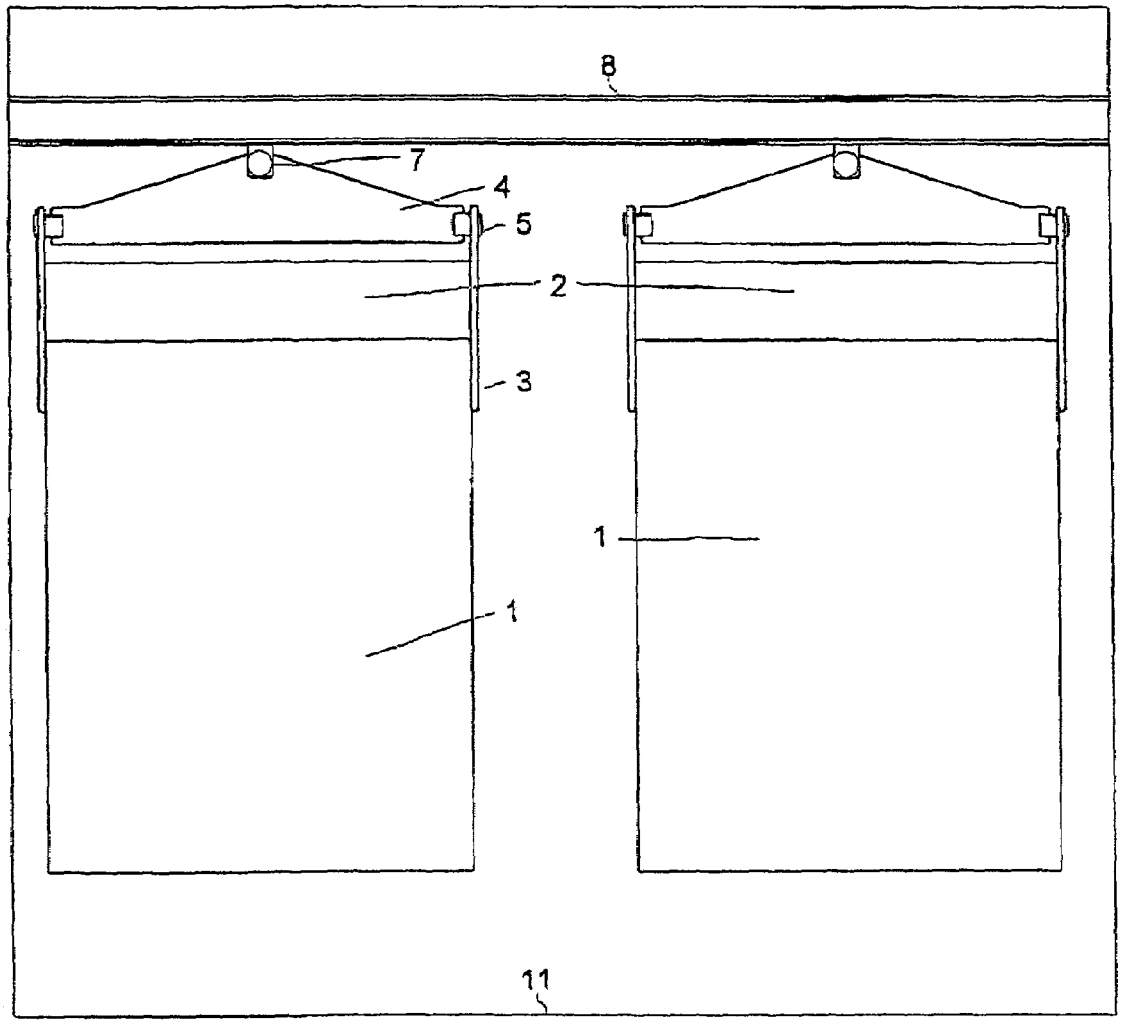
FIG. 3 illustrates a coldbox, indicated with reference number 11, with two heat exchanger blocks (1) hanging on a double-T support (8) which is fixed within the coldbox (11).
Figure 4:
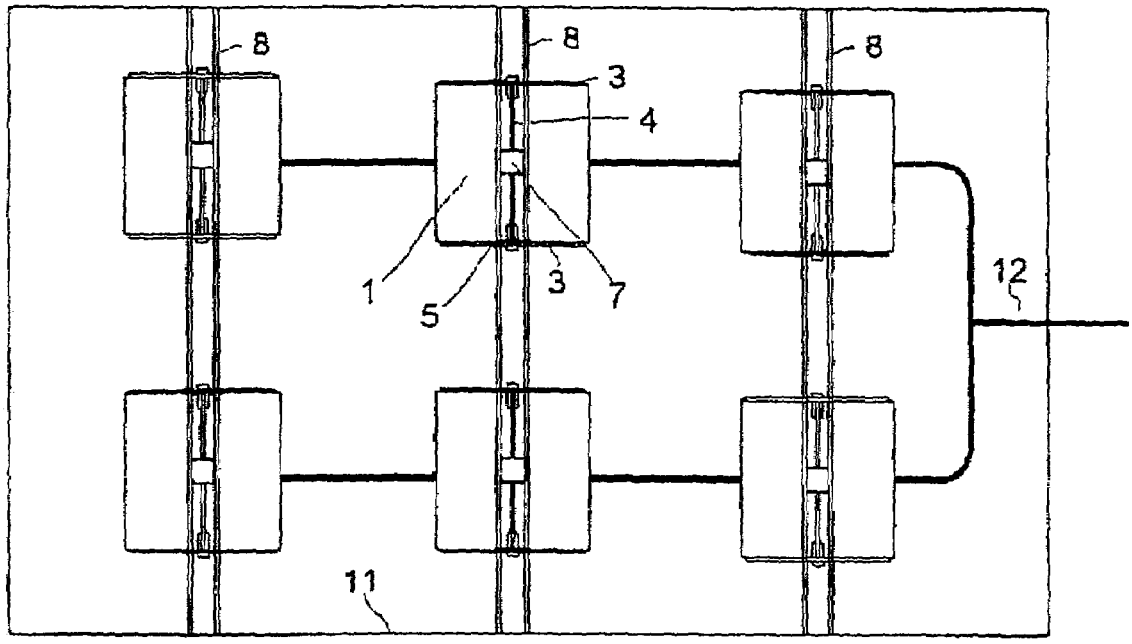
FIG. 4 is a top view of a coldbox (11) enclosing six heat exchanger blocks (1) which are hanging on three double-T supports (8). The figure shows a discharge pipeline connected to the cold end of each heat exchanger block (1) with all discharge pipelines leading to one common connection line (reference number 12).
Figure 5:
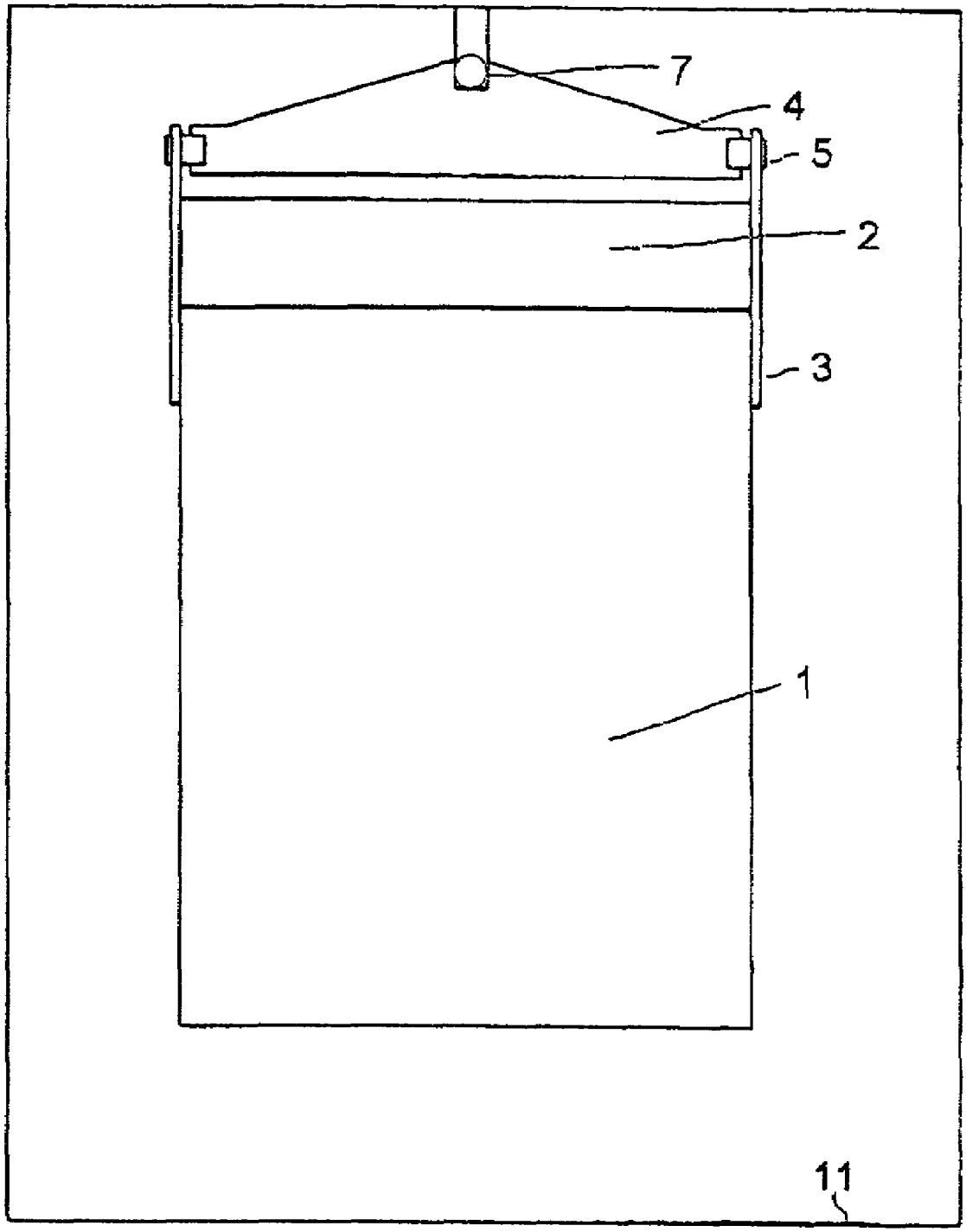
FIG. 5 illustrates a heat exchanger block (1) which is directly fixed to the coldbox (11) without using a double-T support (8).
Figure 6:
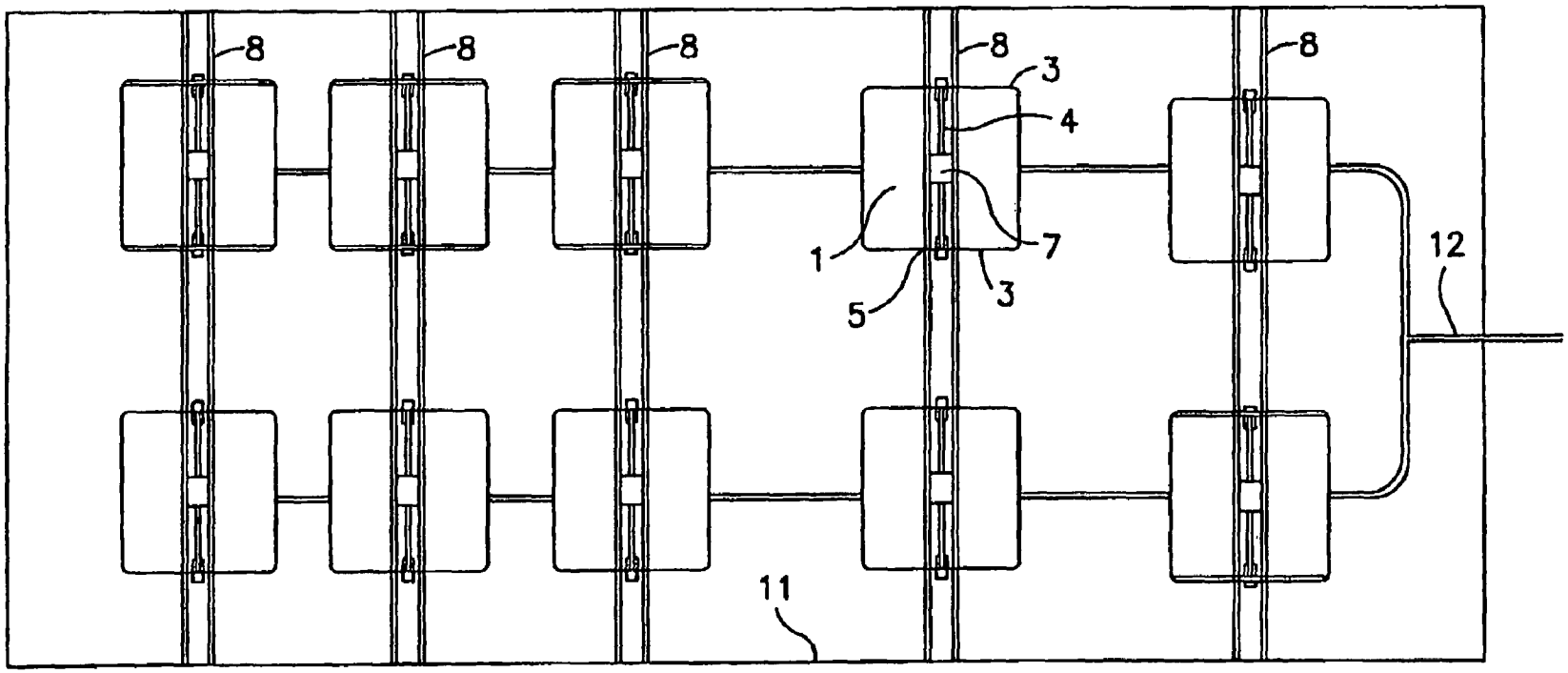
FIG. 6 is similar to FIG. 4 and illustrates a top view of a coldbox (11) enclosing ten heat exchanger blocks (1) in two rows.
Figure 7:
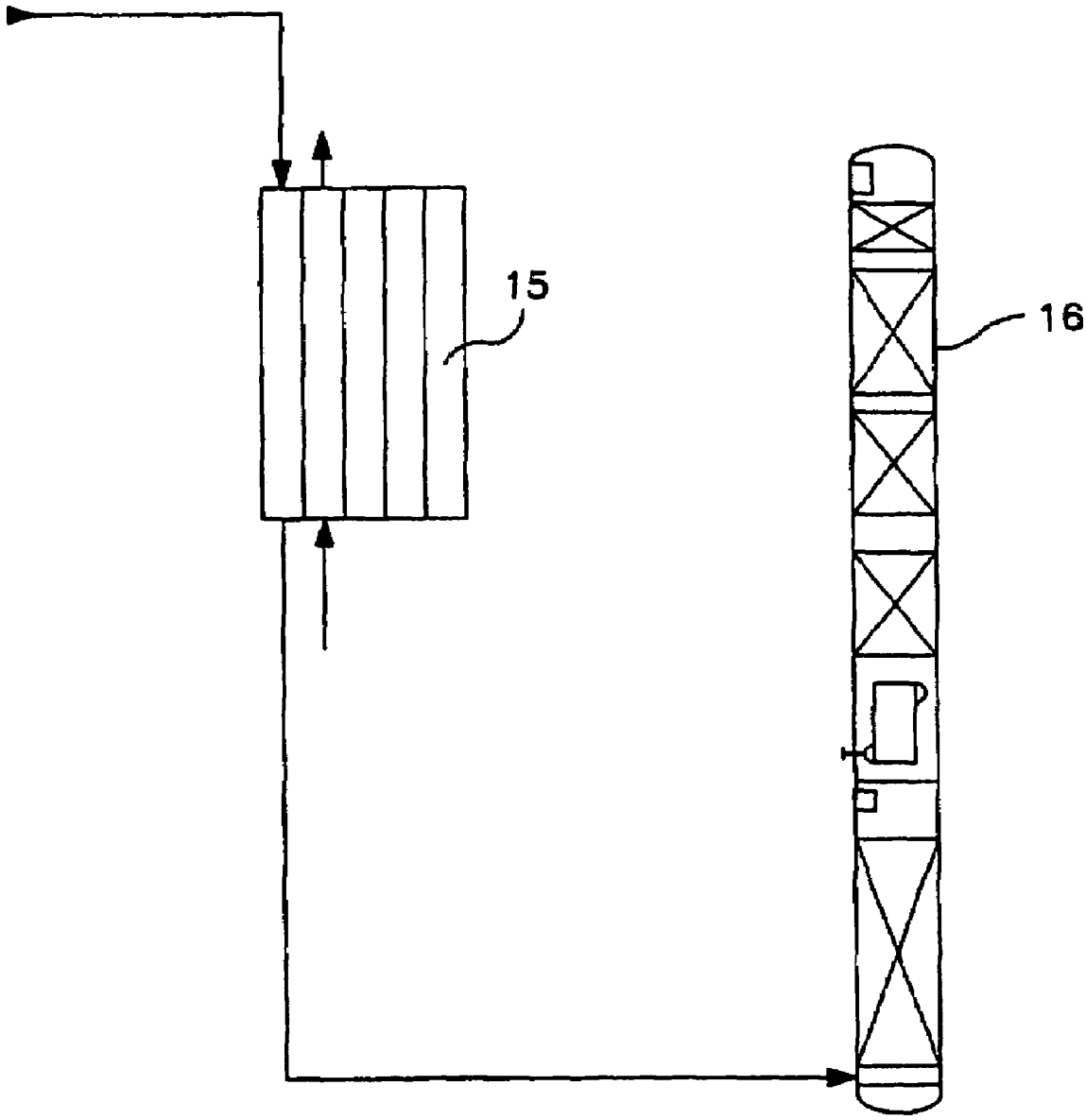
FIG. 7 illustrates a fractionation plant comprising a fractionation column (16) and a principal heat exchanger (15).

FIGS. 1 and 2 show the upper end of a heat exchanger block 1, which is used in the principal heat exchanger of a low-temperature air fractionation plant. The principal heat exchanger as a whole comprises a plurality of heat exchanger blocks 1 of this type connected in parallel.

The heat exchanger block 1 is up to 240 cm wide. A connector/distributor 2, known as a header, is arranged on the heat exchanger block 1, from which header one or more pipelines 13 lead away.

Aluminum plates 3, which project upwards beyond the header 2, are secured to the heat exchanger block 1 on two opposite sides. A substantially triangular steel plate 4 or a steel support which is designed according to static demands is arranged perpendicular to the aluminium plates 3 above the header 2, and is articulately connected to the two aluminium plates 3 at two corners by means of bolts 5. The steel plate 4 can move relative to the heat exchanger block 1 about the axis 6 formed by the extension of the two bolts 5.

At the third corner of the steel plate 4 there is a further joint 7. The steel plate 4 is suspended by means of the joint 7 from a double-T support 8, which is secured in the coldhox 11 (FIGS. 3-6) and supports the heat exchanger block 1. The joint 7 allows movement in the plane of the steel plate 4 or about an axis 9 perpendicular to the steel plate 4.

Therefore, the heat exchanger block 1 is articulately suspended in such a manner that it can rotate about two axes 6, 9 which are perpendicular to one another. The arrangement of the two aluminium plates 3 and of the steel plate 4 is selected in such a way that the suspension point 10 is situated vertically above the center of gravity 17 of the heat exchanger block 1.

In addition, a horizontal movement of the heat exchanger block 1 can be absorbed by means of a suitably selected distance between the aluminium plates 3 and the steel plate 4.

The joint 7 is arranged in such a way that the axis 9 is matched to the project-specific requirements, i.e. to the pipe stresses which occur or can be calculated for a specific design of the heat exchanger.

One or more pipelines for supplying 14 and discharging 12 the fluid streams which are to be brought into heat exchange with one another are arranged at the lower end of the heat exchanger block 1. In the event of load changes and when the plant is being heated and cooled down, these pipelines undergo changes in length of approximately 3 to 4 mm per meter of pipeline length, for thermal reasons. The fact that, according to the invention, the heat exchanger block 1 is suspended above its center of gravity 17 means that it is moved by even relatively minor forces acting on its lower end. The movement of the heat exchanger block 1 compensates for the thermally induced changes in pipe length, so that there is no need for pipe loops for compensating for contraction in the pipelines.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding German application 10110704.8, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

The invention claimed is:

1. In a heat exchanger comprising at least one heat exchanger block, an insulating vessel which surrounds the heat exchanger block, and pipes connected to said heat exchanger block for transporting fluids to and from said heat exchanger block, the improvement wherein said heat exchanger further comprises securing means for securing the heat exchanger block hanging in the insulating vessel, and wherein said means for securing said heat exchanger block permit thermally produced changes in the lengths of said pipes connected to said heat exchange block to be compensated for by movement of said heat exchanger block, wherein the securing means comprises a first element (3), which is fixedly connected to the heat exchanger block (1), and a second element (4), which is articulately connected to the first element (3), the second element (4) being articulately secured in the insulating vessel, and wherein the first element comprises two plates secured to two opposites sides of said heat exchanger block and said second element is a triangular plate.

2. A heat exchanger according to claim 1, wherein said heat exchanger block has a lower end and wherein the lower end of the heat exchanger block (1) can move in at least two spatial directions.

3. A heat exchanger according to claim 2, wherein the heat exchanger block (1) is suspended in such a manner that it can move freely above its center of gravity.

4. A heat exchanger according to claim 1, wherein the heat exchanger block (1) is suspended in such a manner that it can move freely above its center of gravity.

5. A heat exchanger according to claim 1, wherein the heat exchanger comprises at least two heat exchanger blocks (1).

6. A heat exchanger according to claim 5, wherein said pipes connected to said heat exchange block comprise feed and/or discharge lines which lead into a common connection line.

7. A heat exchanger according to claim 5, comprising at least three heat exchanger blocks.

8. A heat exchanger according to claim 1, wherein the securing means have joints (5, 7).

9. A heat exchanger according to claim 8, wherein the securing means have two axes of rotation (6, 9) which lie perpendicular to one another.

10. A heat exchanger according to claim 1, wherein said heat exchanger comprises ten heat exchanger blocks arranged in two rows of five blocks each.

11. A heat exchanger according to claim 1, wherein said heat exchanger comprises eight heat exchanger blocks arranged in two rows of four blocks each.

12. In a low-temperature air fractionation plant comprising a principal heat exchanger and at least one fractionation column, the improvement wherein said principal heat exchanger comprises:

at least one heat exchanger block, an insulating vessel which surrounds the heat exchanger block, pipes connected to said heat exchanger block for transporting fluids to and from said heat exchanger block, and securing means for securing the heat exchanger block hanging in the insulating vessel, wherein said means for securing said heat exchanger block permit thermally produced changes in the lengths of said pipes connected to said heat exchange block to be compensated for by movement of said heat exchanger block.

13. An air fractionation plant according to claim 12, wherein said heat exchanger block has a lower end and wherein the lower end of the heat exchanger block (1) can move in at least two spatial directions.

14. An air fractionation plant according to claim 13, wherein the heat exchanger block (1) is suspended in such a manner that it can move freely above its center of gravity.

15. An air fractionation plant according to claim 12, wherein the heat exchanger block (1) is suspended in such a manner that it can move freely above its center of gravity.

16. An air fractionation plant according to claim 12, wherein the heat exchanger comprises at least two heat exchanger blocks (1).

17. An air fractionation plant according to claim 16, comprising at least three heat exchanger blocks.

18. An air fractionation plant according to claim 16, wherein said pipes connected to said heat exchange block comprise feed and/or discharge lines which lead into a common connection line.

19. An air fractionation plant according to claim 12, wherein the securing means have joints (5, 7).

20. An air fractionation plant according to claim 19, wherein the securing means have two axes of rotation (8, 12) which lie perpendicular to one another.

21. An air fractionation plant according to claim 12, wherein the securing means have a first element (3), which is fixedly connected to the heat exchanger block (1), and a second element (4), which is articulately connected to the first element (3), the second element (4) being articulately secured in the insulating vessel.

22. An air fractionation plant according to claim 21, wherein said first element comprises two plates secured to two opposites side of said heat exchanger block and said second element is a triangular plate.

23. An air fractionation plant according to claim 12, wherein said heat exchanger comprises ten heat exchanger blocks arranged in two rows of five blocks each.

24. An air fractionation plant according to claim 12, wherein said heat exchanger comprises eight heat exchanger blocks arranged in two rows of four blocks each.

25. A heat exchanger comprising at least one heat exchanger block having an upper end and a lower end, an insulating vessel which surrounds said at least one heat exchanger block, pipes connected to the upper end and pipes connect to the lower end of said heat exchanger block for transporting fluids to and from said heat exchanger block, a first support plate attached to said heat exchange block at a first side of said upper end of said heat exchange block, a second support plate attached to said heat exchange block at a side opposite said first said of said upper end of said heat exchange block, and a third support plate attached to a support within said insulating box, wherein said first and second support plates are pivotally attached to said third support plate whereby said lower end of said heat exchange block is free to pivot about an axis passing through the plane of said third support plate, and said third support plate is attached to said support by a joint which permits said third support plate and said heat exchange block to pivot about an axis perpendicular to the plane of said third support plate.

26. A heat exchanger according to claim 25, wherein said third support plate is a triangular plate.

27. A heat exchanger according to claim 25, wherein said heat exchanger comprises at least two, heat exchanger blocks.

28. A heat exchanger according to claim 27, comprising at least four heat exchanger blocks.

29. In a low-temperature air fractionation plant comprising a principal heat exchanger and at least one fractionation column, the improvement wherein said principal heat exchanger comprises:

at least one heat exchanger block having an upper end and a lower end, an insulating vessel which surrounds said at least one heat exchanger block, pipes connected to the upper end and pipes connect to the lower end of said heat exchanger block for transporting fluids to and from said heat exchanger block, a first support plate attached to said heat exchange block at a first side of said upper end of said heat exchange block, a second support plate attached to said heat exchange block at a side opposite said first said of said upper end of said heat exchange block, and a third support plate attached to a support within said insulating box, wherein said first and second support plates are pivotally attached to said third support plate whereby said lower end of said heat exchange block is free to pivot about an axis passing through the plane of said third support plate, and said third support plate is attached to said support by a joint which permits said third support plate and said heat exchange block to pivot about an axis perpendicular to the plane of said third support plate.

* * * * *

UNITED STATES PATENT AND TRADEMARK OFFICE

CERTIFICATE OF CORRECTION

PATENT NO. : 7,325,594 B2
APPLICATION NO. : 10/091350
DATED : February 5, 2008
INVENTOR(S) : Wolfgang Bader It is certified that error appears in the above-identified patent and that said Letters Patent is hereby corrected as shown below:

Column 5, line 37, reads “axes of rotation (8, 12)” should read --axes of rotation (6, 9)--
Column 5, line 47, reads “two opposites side” should read --two opposite sides--
Column 6, line 5, reads “connect to the lower end” should read --connected to the lower end--
Column 6, line 10, reads “said first said” should read --said first side--
Column 6, line 24, reads “at least two, heat” should read --at least two heat--
Column 6, line 36, reads “connect to the lower end” should read --connected to the lower end--
Column 6, line 42, reads “said first said” should read --said first side--

Signed and Sealed this

Sixteenth Day of December, 2008

JON W. DUDAS
*Director of the United States Patent and Trademark Office*